US006230961B1

(12) United States Patent
Graser

(10) Patent No.: US 6,230,961 B1
(45) Date of Patent: May 15, 2001

(54) PLATE LINK FOR ATTACHING A CLASP LINK TO AN ORNAMENTAL CHAIN AND A METHOD OF ATTACHING THE END OF A CHAIN TO A CLASP LINK

(76) Inventor: Sergio Graser, Via Vittoria, 13, Mussolente, Vicenza (IT)

( * ) Notice: Subject to any disclaimer, the term of this patent is extended or adjusted under 35 U.S.C. 154(b) by 0 days.

(21) Appl. No.: 09/467,335

(22) Filed: Dec. 20, 1999

Related U.S. Application Data

(63) Continuation-in-part of application No. 09/057,958, filed on Apr. 9, 1998.

(51) Int. Cl.[7] ..... B21L 3/00; A44C 27/00

(52) U.S. Cl. ..... 228/192; 228/164; 228/141.1; 63/3.1; 29/896.42

(58) Field of Search ..... 228/141.1, 192, 228/135, 139, 164; 63/3.1; 29/896.42; 219/51, 52

(56) References Cited

U.S. PATENT DOCUMENTS 1,380,827 * 6/1921 Mullins .
1,449,175 * 4/1923 Grunebaum .
3,720,391 * 3/1973 Wahlbeck ..... 245/4
4,000,627 * 1/1977 Wahlbeck ..... 63/2
4,219,919 * 9/1980 Fischbein et al. ..... 29/270
4,298,154 * 11/1981 DeFusco ..... 228/49 R
4,305,262 * 12/1981 Ferrara ..... 63/29 R
4,388,513 * 6/1983 Brastow et al. ..... 219/58
4,483,050 * 11/1984 Nanni et al. ..... 24/239
4,769,884 * 9/1988 Dasteris et al. ..... 29/33 K
5,058,252 * 10/1991 Wiesner, II et al. ..... 29/33 K
5,669,242 * 9/1997 Cayton ..... 63/21
5,794,459 * 8/1998 Ignatowski ..... 63/38

FOREIGN PATENT DOCUMENTS

2210248 * 7/1989 (GB) .

* cited by examiner

*Primary Examiner*—Patrick Ryan
*Assistant Examiner*—Colleen P. Cooke
(74) *Attorney, Agent, or Firm*—Bucknam and Archer

(57) ABSTRACT

A plate link (1), for attaching a clasp link (5) to the end of an ornamental chain (4), is provided for welding electrically at point (2) to constitute an unopenable ring, at one side of which is attached the end (3) of the ornamental chain (4) and at the other side of the clasp link (5) of a normal type. The novel method of attaching the end of a chain to a clasp link by means of the plate link involves the use of electrically welding the plate link and is carried out in the absence of any weld material.

1 Claim, 1 Drawing Sheet

Figure 1:
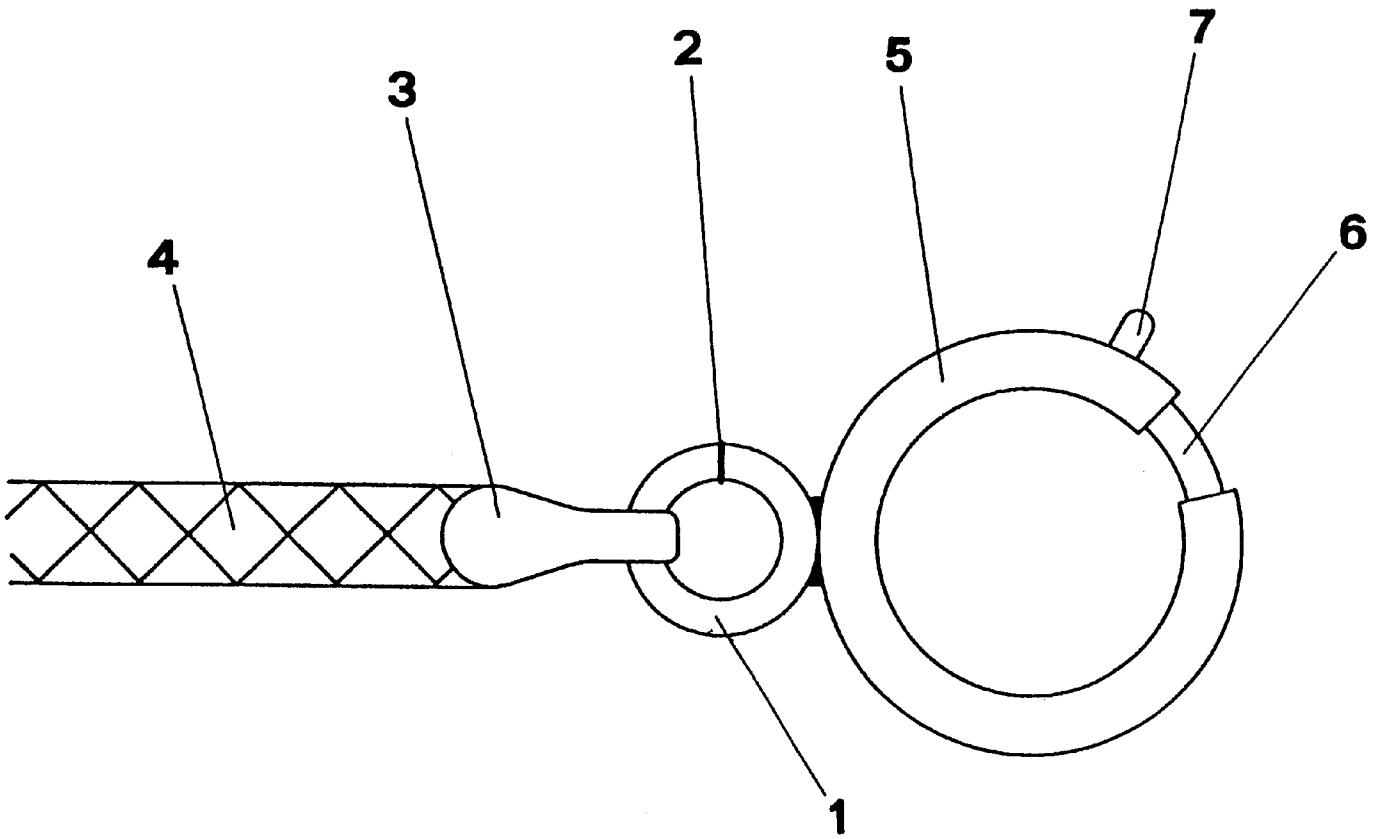

PLATE LINK FOR ATTACHING A CLASP LINK TO AN ORNAMENTAL CHAIN AND A METHOD OF ATTACHING THE END OF A CHAIN TO A CLASP LINK

This application is a continuation-in-part of U.S. Ser. No. 09/057,958, filed Apr. 9, 1998.

The invention relates to a plate link for attaching a clasp link to an ornamental chain. An object is to make such a link safer.

The invention also covers a method of attaching the end of a chain to a clasp link by means of a plate link. This method involves the use of electrically welding the plate link and is carried out in the absence of weld material.

The present invention provides a plate link attaching a clasp link to the end of an ornamental chain, characterized in that the link is electrically welded without any weld metal, thus ensuring maximum hold even against considerable force applied to the chain and the clasp link. Because the link is closed by electric welding, it prevents the clasp link or the end of the chain from becoming detached in any way.

An embodiment of the invention is illustrated in the attached drawing by way of example.

FIG. 1 represents an overall view of a plate link, attached at one side to a clasp link and at the other side to the end of a chain.

As will be noted from the drawing, the plate link 1, open initially at point 2, permits the insertion of a folded sheet metal end 3 of an ornamental chain 4. One side of the link 1 is welded to a clasp link 5, with clasp 6 being operated by the knob 7, according to a method well known in the art.

The novelty of the model consists essentially of the fact that the plate link 1, after insertion of the end 3 of the ornamental chain 4, is welded electrically, in such a manner as to constitute an inseparable element, which completely prevents the end 3 from becoming detached, even in the event of ill-treatment or accidental misuse.

The advantage of applicant's method is clear if one considers that when weld material is used, the temperature should be very high, about 800° C. and damage to the clasp link would occur. According to the method of this application no weld material is used and the plate link is electrically welded.

This, then, is a significant novelty feature in regard to its utility, as it ensures that the ornamental chain 4 is coupled in the most secure manner to the clasp link 5.

Obviously the part can be applied to any type of ornamental chain, whether neck-chain, bracelet, chains of various kinds for wearing round the waist, on a dress for winding several times around the arm or neck of the user.

Naturally both the dimensions and the materials used can be of any type, precious or otherwise, depending on the particular conditions.

What is claimed is:

1. A method of attaching the end of a chain (3) to a clasp link (5) by means of a plate link (1), said plate link being openable at point (2), said clasp link (5) being open by means of clasp (6), said clasp (6) being operated by means of a knob (7), which consists of the following steps:

1) opening said plate link (1) at point (2), 2) inserting said end of the chain into said plate link, 3) attaching said clasp link (5) to said plate link (1), 4) closing said plate link (1), 5) electrically welding said plate link in the absence of any weld material.

* * * * *